US006945256B2

(12) United States Patent
Earl

(10) Patent No.: US 6,945,256 B2
(45) Date of Patent: Sep. 20, 2005

(54) FOLDING TOOTHBRUSH WITH PASTE IN HANDLE

(76) Inventor: Gerald W. Earl, 4584 County Rd. 45, Maplesville, AL (US) 36750

( * ) Notice: Subject to any disclaimer, the term of this patent is extended or adjusted under 35 U.S.C. 154(b) by 301 days.

(21) Appl. No.: 10/454,489

(22) Filed: Jun. 5, 2003

(65) Prior Publication Data

US 2004/0020508 A1 Feb. 5, 2004

Related U.S. Application Data

(60) Provisional application No. 60/400,688, filed on Aug. 5, 2002.

(51) Int. Cl.[7] ..... A46B 11/00; B43K 5/06

(52) U.S. Cl. ..... 132/311; 401/268; 401/175

(58) Field of Search ..... 132/311, 308; 401/171, 172, 174, 175, 181, 191, 268; 222/390, 534; 16/274, 342

(56) References Cited

U.S. PATENT DOCUMENTS

| | | | | |
|---|---|---|---|---|
| 1,033,022 A | | 7/1912 | Kress | |
| 2,110,461 A | | 8/1938 | Chibnik | |
| 4,275,750 A | | 6/1981 | Clark | |
| 4,288,169 A | * | 9/1981 | McMenamin, IV | 401/175 |
| 4,467,822 A | * | 8/1984 | Blackwell | 401/175 |
| 4,530,369 A | | 7/1985 | Adams | |
| 4,759,381 A | * | 7/1988 | Cesari | 132/311 |
| 5,382,107 A | | 1/1995 | Nian | |

* cited by examiner

*Primary Examiner*—Kevin Shaver
*Assistant Examiner*—Stephanie Willatt
(74) *Attorney, Agent, or Firm*—Richard C. Litman

(57) ABSTRACT

A folding toothbrush assembly is provided with an integral toothpaste dispenser. The toothbrush is formed with an elongated arm having a head portion at one end with bristles for brushing the teeth and a pivot portion at an opposite end of the arm. The arm is pivotally received at one end of an elongated handle that is provided with an exterior stepped recess for receiving the arm when the assembly is folded for storage. A piston chamber is provided in the handle of the toothbrush for receiving toothpaste. A piston in the chamber is operated by a screw cap at the bottom of the handle to dispense toothpaste from the chamber through a passage in the arm and into the bristles of the toothbrush.

20 Claims, 6 Drawing Sheets

FOLDING TOOTHBRUSH WITH PASTE IN HANDLE

CROSS-REFERENCE TO RELATED APPLICATION

This application claims the benefit of U.S. Provisional Patent Application Ser. No. 60/400,688, filed Aug. 5, 2002.

BACKGROUND OF THE INVENTION

1. Field of the Invention

The present invention relates to a toothbrush, more particularly to a foldable toothbrush having means for selectively dispensing toothpaste to the bristles of the toothbrush.

2. Description of Related Art

Folding toothbrushes are well known in the prior art for providing a convenient way for travelers to carry toothbrushes, so as to be able to practice dental hygiene when not at home. Folding the toothbrush results in a more compact storage size whereby the toothbrush can be easily stored in a desk, pocket or purse. U.S. Pat. No. 2,110,461, issued May 12, 1937 to Chibnik, and U.S. Pat. No. 1,033,022, issued Jul. 16, 1912 to Kress, both teach folding toothbrushes having a handle that functions as a storage space for the bristle holding portion of the toothbrushes. The bristle holding portion of the toothbrushes are folded into the handle for storage.

U.S. Pat. No. 4,275,750, issued Jun. 30, 1981, shows a self-contained toothbrush wherein a toothpaste container is stored within the hollow handle of the brush and removed to apply the paste to the bristles of the toothbrush.

It is also known in the prior art to include a measure of toothpaste with the toothbrush for further convenience to a user. A fountain toothbrush is taught in U.S. Pat. No. 4,530,369, which issued Jul. 23, 1985 to Adams. The fountain toothbrush of Adams has a piston driven by an adjustable screw cap that forces toothpaste stored in a piston chamber within the handle through passages in the toothbrush leading to the bristles in the head of the toothbrush.

In the U.S. Pat. No. 5,382,107, issued Jan. 17, 1995 to Nian, a foldable toothbrush is disclosed wherein the brush head is folded into a storage space in the handle of the toothbrush. The toothbrush of Nian also has a piston chamber having an opening adjacent to the bristles of the toothbrush head when the brush head is folded into the storage position. An adjustable screw mechanism having a threaded rod and turning knob moves a piston in the form of a circular disc within the piston chamber to extrude toothpaste into a bristle and toothpaste-receiving storage space in the handle of the toothbrush.

None of the above inventions and patents, taken either singly or in combination, is seen to describe the instant invention as claimed.

SUMMARY OF THE INVENTION

A folding toothbrush assembly is provided with means for holding toothpaste within the handle for dispensing selective amounts of toothpaste into the bristles of the toothbrush. The toothbrush has an elongated arm having a head portion at one end with bristles extending therefrom and a pivot portion at an opposite end for attachment to a pivot end of the handle. A securing element pivotally connects the pivot portion of the arm to the pivot end of the handle. The elongated handle is provided with an exterior stepped recess for receiving the arm when the toothbrush assembly is folded for storage. A piston chamber is provided within the handle of the toothbrush for receiving and dispensing the toothpaste. A piston is longitudinally movable within the piston chamber in response to rotation of a screw cap rotatably secured at one end of the handle portion. The screw cap sealingly closes the open end of the piston chamber. Passages are provided through the arm from the head portion to an axial passage in the pivot portion. Passages are also provided through the pivot end of the handle to communicate the closed end of the piston chamber with openings of the axial passage in the pivot portion of the arm. Oaring seals are provided for sealing the junctions between the openings of the passage of the axial passage and the opening of the passage in the pivot end of the handle. Rotating the screw cap causes the piston to force toothpaste out of the piston chamber, through the pivotal connection, through the passages of the arm and into the bristles of the toothbrush.

Accordingly, it is a principal object of the invention to provide a toothbrush that is foldable for compact storage within a desk, pocket or purse that permits one to practice dental hygiene anywhere at anytime.

It is another object of the invention to provide a foldable toothbrush having a storage chamber in the handle for storing a supply of toothpaste.

It is a further object of the invention to provide a compact folding toothbrush with a toothpaste dispenser stored within the handle for dispensing toothpaste through passages leading to the bristles of the toothbrush.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
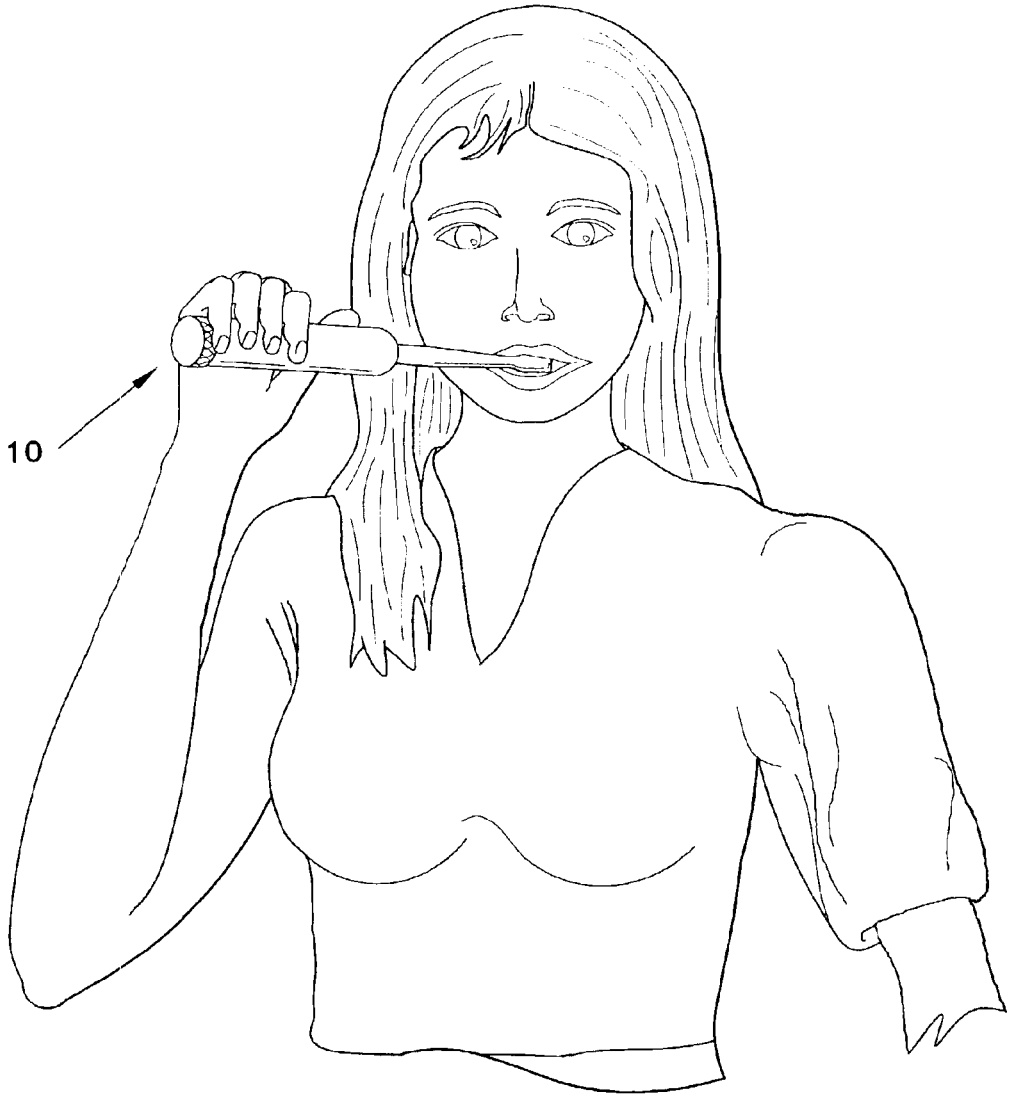
FIG. 1 is an environmental, perspective view of a folding toothbrush with paste in the handle according to the present invention.
Figure 2:
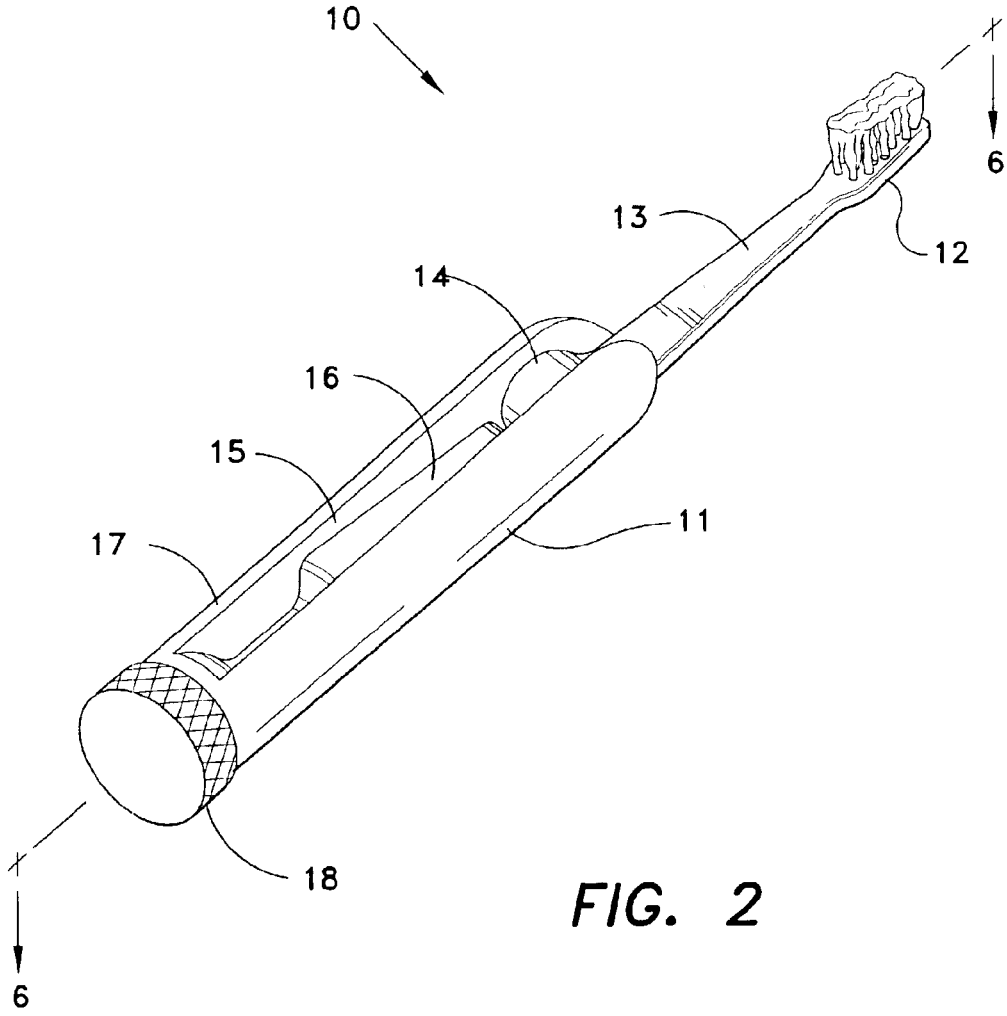
FIG. 2 is a perspective view of a toothbrush in the unfolded position when ready for use according to the present invention.
Figure 4:
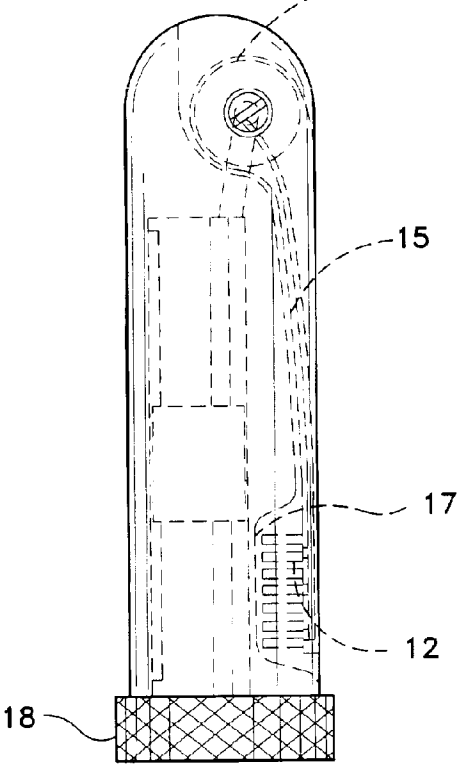
FIG. 4 is a side view of the toothbrush in the folded position according to the present invention.
Figure 3:
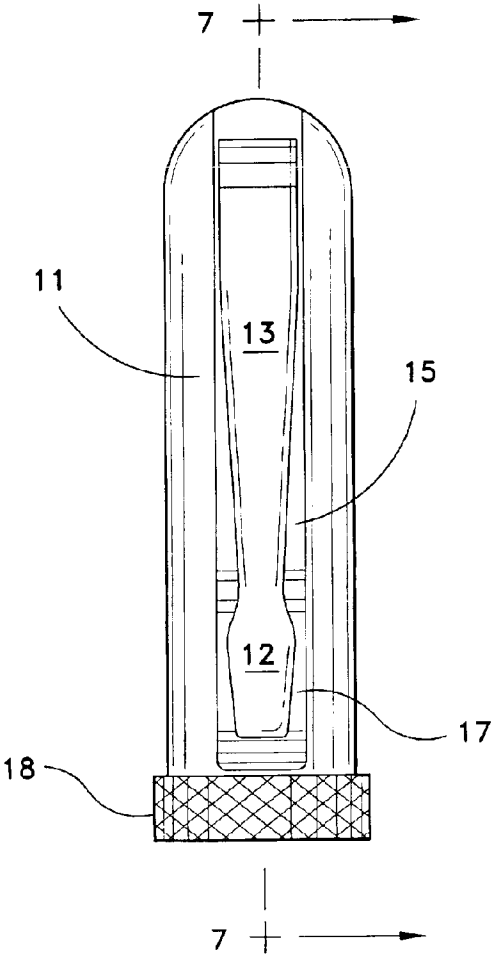
FIG. 3 is a front view of the toothbrush in the folded storage position according to the present invention.
Figure 7:
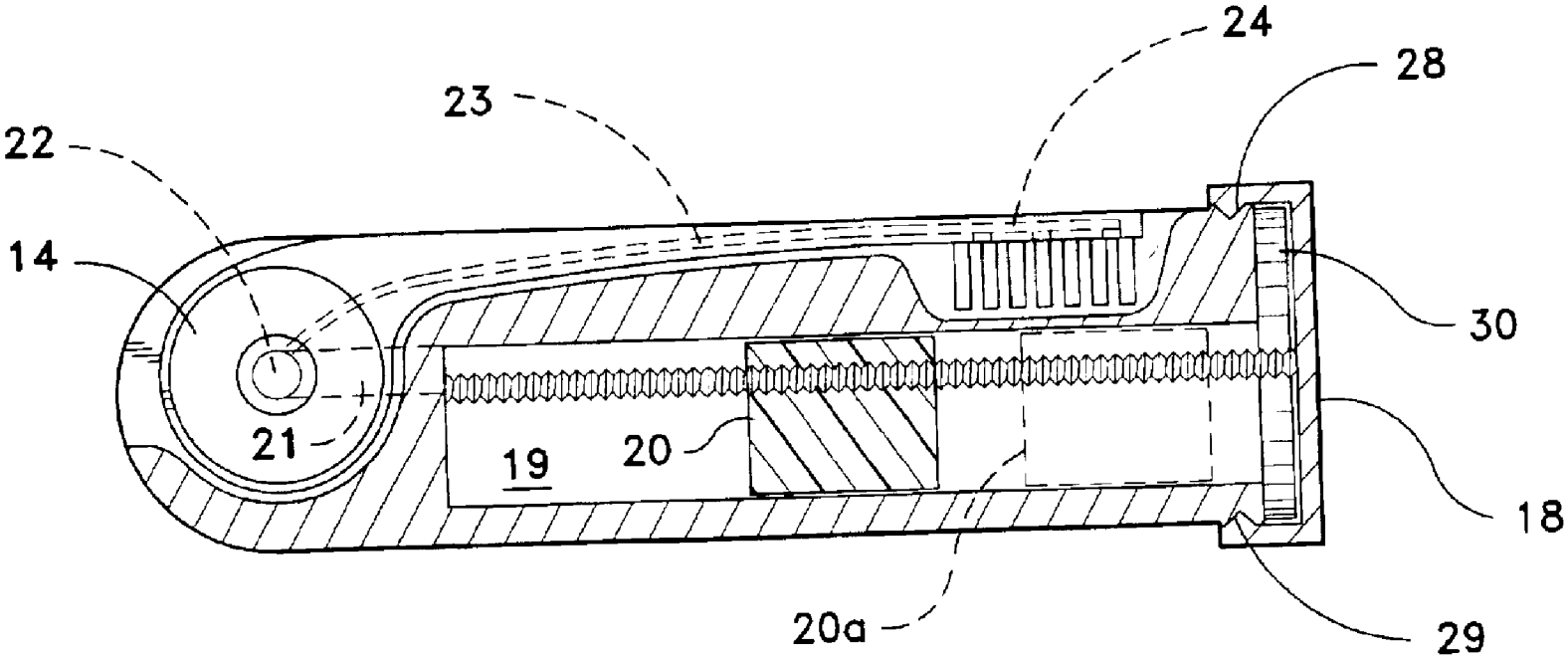
FIG. 7 is a cross-sectional view of the folded toothbrush assembly taken along line 7—7 of FIG. 3.

The present invention is a folding toothbrush assembly, designated generally as 10 in the drawings, having a chamber 19 in the handle for storing a measure of toothpaste. Referring first to FIG. 2, a perspective view of the toothbrush assembly is shown. An arm 13 is shown having a pivot portion 14 and a head portion 12 containing the bristles of the toothbrush. The pivot portion 14 is pivotally secured to a pivot end of the handle 11 of the toothbrush. The handle 11 is provided exteriorly with a shaped recess 15 for receiving the arm 13. Recess 15 has a first step portion 16 and a second lower step portion 17 for receiving the head portion 12 of the toothbrush including the attached bristles. A snap-on screw cap 18 or similar mechanism is rotatably mounted at a second end of the handle 11 for closing off the open end of chamber 19. As best seen in FIGS. 3, 4 and 7, the arm 13 folds neatly into the recess 15 in the handle 11 so that the bristles of the toothbrush 10 are not exposed to the environment and the folded toothbrush 10 has a generally smooth cylindrical exterior contour.

Figure 5:
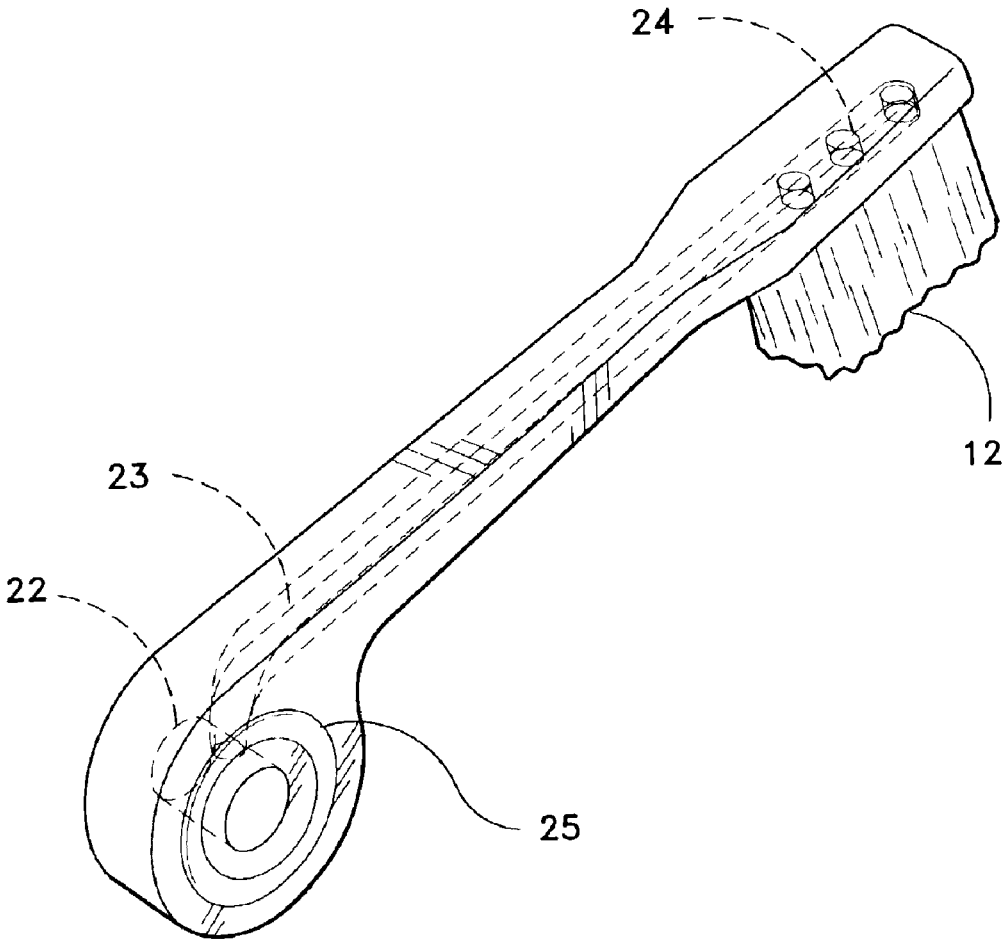
FIG. 5 is a perspective of the toothbrush arm of FIG. 2 according to the present invention removed from the handle assembly.
Figure 6:
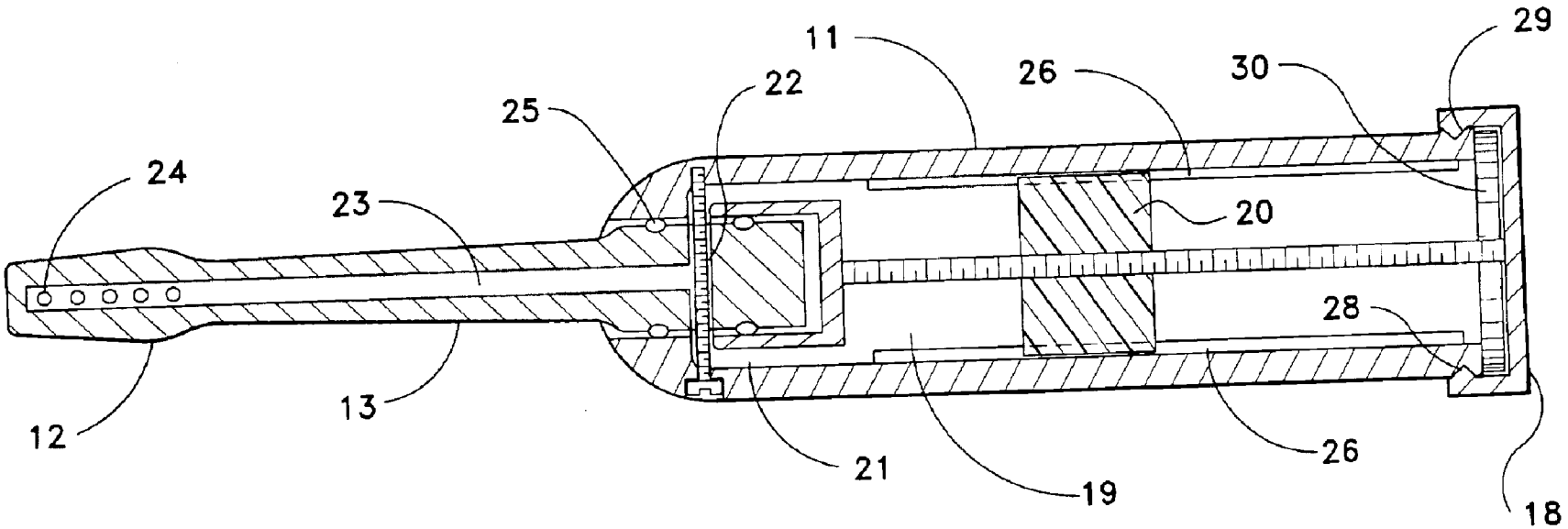
FIG. 6 is a cross-sectional view of the unfolded toothbrush taken along lines 6—6 of FIG. 2.

FIG. 5 shows the arm 13 removed from the handle 11. An axial passage 22 is shown on the pivot axis of pivot portion 14 and a passage 23 is shown within arm 13 that connects the axial passage 22 with openings 24 in the surface of the head portion 12 near the bristles. O-ring gaskets 25 are placed within annular recesses in both side faces of the pivot portion. FIG. 6 shows the sealing arrangement between the openings of passage 22 in pivot portion 14 of the arm 13 and the openings of passages 21 leading to piston chamber 19 within the handle 11. Piston chamber 19 may be designed to hold a three to four day supply of toothpaste.

A snap-on screw cap 18 having an annular skirt 29 closes the open end of the handle. Screw cap 18 includes an integrally formed threaded screw portion that cooperates with a threaded aperture in a piston 20 to move the piston longitudinally within the piston chamber 19. The exterior surface of the screw cap 18 is knurled to facilitate turning of the screw cap 18 by hand.

With the piston chamber 19 filled with the supply of toothpaste, the piston is positioned as shown at 20*a* in FIG. 7. Turning the screw cap 18 moves the piston 20 toward the closed end of the piston chamber 19 to force toothpaste out of the piston chamber 19 and through passages 21, 22, 23 and 24 and into the bristles on the toothbrush head portion 12.

The piston 20 may be constructed with an O-ring for sealing against the walls of the piston chamber 19, or the chamber wall and piston 20 could be provided with a cooperating guide and groove, respectively, to prevent the piston 20 from rotating within the piston chamber 19 when the threaded screw portion of the screw cap 18 is rotated.

FIGS. 6 and 7 show an annular groove 28 is provided around the handle 11 near the open end of the handle 11 for cooperating with a detent on the inner surface of the skirt 29 of the screw cap 18 to rotatably and releasably secure the screw cap 18 onto the handle 11. A rubber washer ring 30 may be provided to provide a seal between the rotating screw cap 18 and the open end of the piston chamber 19. It is to be understood that the present invention is not limited to the sole embodiments described above, but encompasses any and all embodiments within the scope of the following claims.

I claim:

1. A folding toothbrush with integral toothpaste dispenser, comprising:

an elongated arm including a head portion at one end with bristles extending therefrom and a pivot portion at an opposite end of said arm, said arm having an axial passage defined along the pivot axis of said pivot portion, said head portion having transverse passages with openings near the bristles, said arm further including a longitudinal passage therein in fluid communication with the transverse passages of the head portion and the axial passage of the pivot portion;

an elongated handle having an exterior recess for receiving said arm therein for storage, said pivot portion of said arm being pivotally received at a pivot end of said handle in said exterior recess and said head portion with bristles being received adjacent a second end of said handle in said exterior recess, said handle having at least one handle passage in said pivot end in fluid communication with said axial passage of said pivot portion of said arm, said handle having a piston chamber defined therein extending from said at least one handle passage in said pivot end to an opening defined in the second end of said handle;

O-ring seals seated in grooves on said pivot portion and said pivot end of said handle for sealing connection of the axial passage in said arm to said at least one handle passage;

means for pivotally securing said pivot portion of said arm to said pivot end of said handle;

a screw cap rotatably secured to the second end of said handle, said screw cap closing said piston chamber opening defined in said second end of said handle, a threaded rod extending from the center of said screw cap through said piston chamber; and a piston threadedly attached to said threaded rod, said piston being linearly movable within said piston chamber along said rod in response to rotation of said screw cap to force toothpaste out of the piston chamber and into the bristles of said arm.

2. The toothbrush according to claim 1, including a washer seal within said screw cap for sealing said opening at said second end of said handle.

3. The toothbrush according to claim 2, wherein said screw cap includes an annular skirt with interior and exterior surfaces, and a protrusion on the interior surface of said skirt cooperatively engages a circumferential groove adjacent said second end said handle to rotatably secure said screw cap onto said handle.

4. The toothbrush according to claim 3, wherein the exterior surface of said skirt is knurled to facilitate turning of the screw cap.

5. The toothbrush according to claim 1, wherein said means for pivotally securing said pivot portion of said arm to said pivot end of said handle comprises a threaded fastener which passes through said at least one handle passage and said axial passage of said pivot portion of said arm.

6. The toothbrush according to claim 1, wherein said exterior recess of said handle includes a first step and a second lower step portion for receiving said head portion and bristles of said arm.

7. The toothbrush according to claim 1, further including means for preventing rotation of said piston in response to rotation of said threaded rod.

8. The toothbrush according to claim 7, wherein said means for preventing rotation of said piston comprises grooves on said piston cooperating with guides in said piston chamber.

9. The toothbrush according to claim 1, wherein two oppositely disposed handle passages are provided in said pivot end of said handle in communication with said axial passage of said pivot portion of said arm and said piston chamber.

10. The toothbrush according to claim 9, wherein a pair of O-ring seals are provided to seal the junctions between the openings of said axial passage of said pivot portion of said arm and the openings of said handle passages.

11. The toothbrush according to claim 1, including an O-ring positioned around said piston for providing a seal between said piston and said piston chamber.

12. A folding toothbrush with integral toothpaste dispenser, comprising:

an elongated arm including a head portion at one end with bristles extending therefrom and a pivot portion at an opposite end of said arm, said arm having an axial passage defined along the pivot axis of said pivot portion, said head portion having transverse passages with openings near the bristles, said arm further including a longitudinal passage therein in fluid communication with the transverse passages of the head portion and the axial passage of the pivot portion;

an elongated handle having an exterior recess for receiving said arm therein for storage, said pivot portion of said arm being pivotally received at a pivot end of said handle in said exterior recess and said head portion with bristles being received adjacent a second end of said handle in said exterior recess, said handle having at least one handle passage in said pivot end in fluid communication with said axial passage of said pivot portion of said arm, said handle having a piston chamber defined therein extending from said at least one handle passage in said pivot end to an opening defined in the second end of said handle;

O-ring seals seated in grooves on said pivot portion and said pivot end of said handle for sealing connection of the axial passage in said arm to said at least one handle passage;

a threaded fastener for pivotally securing said pivot portion of said arm to said pivot end of said handle, said threaded fastener passing through said at least one handle passage and said axial passage of said pivot portion of said arm;

a screw cap rotatably secured to the second end of said handle, a threaded rod extending from the center of said screw cap through said piston chamber, said screw cap including a washer seal within said screw cap for sealing said piston chamber opening at said second end of said handle; and a piston threadedly attached to said threaded rod, said piston being linearly movable within said piston chamber along said rod in response to rotation of said screw cap to force toothpaste out of the piston chamber and into the bristles of said arm.

13. The toothbrush according to claim 12, wherein said screw cap includes an annular skirt with interior and exterior surfaces, and a protrusion on the interior surface of said skirt cooperatively engages a circumferential groove adjacent said second end said handle to rotatably secure said screw cap onto said handle.

14. The toothbrush according to claim 13, wherein the exterior surface of said skirt is knurled to facilitate turning of the screw cap.

15. The toothbrush according to claim 12, wherein said exterior recess of said handle includes a first step and a second lower step portion for receiving said head portion and bristles of said arm.

16. The toothbrush according to claim 12, further including means for preventing rotation of said piston in response to rotation of said threaded rod.

17. The toothbrush according to claim 16, wherein said means for preventing rotation of said piston comprises grooves on said piston cooperating with guides in said piston chamber.

18. The toothbrush according to claim 12, wherein two oppositely disposed handle passages are provided in said pivot end of said handle in communication with said axial passage of said pivot portion of said arm and said piston chamber.

19. The toothbrush according to claim 18, wherein a pair of O-ring seals are provided to seal the junctions between the openings of said axial passage of said pivot portion of said arm and the openings of said handle passages.

20. The toothbrush according to claim 1, including an O-ring positioned around said piston for providing a seal between said piston and said piston chamber.

* * * * *